United States Patent [19]

Laky

[11] Patent Number: 5,002,130

[45] Date of Patent: Mar. 26, 1991

[54] SYSTEM FOR HANDLING REELED TUBING

[75] Inventor: Tibor Laky, Dallas, Tex.

[73] Assignee: Otis Engineering Corp., Dallas, Tex.

[21] Appl. No.: 471,386

[22] Filed: Jan. 29, 1990

[51] Int. Cl.[5] ..... E21B 19/09; E21B 19/22

[52] U.S. Cl. ..... 166/351; 166/54; 166/77; 166/335

[58] Field of Search ..... 166/77, 81, 84, 82, 166/85, 75.1, 379, 384, 54, 356, 351, 335

[56] References Cited

U.S. PATENT DOCUMENTS

| | | | |
|---|---|---|---|
| 2,262,364 | 11/1941 | Hugel et al. | 166/77 |
| 2,684,118 | 7/1954 | Osmun | 166/70 |
| 2,790,624 | 4/1957 | Lofqvist et al. | 277/164 |
| 3,313,346 | 4/1967 | Cross | 166/77 X |
| 4,201,074 | 5/1980 | Cox | 166/356 X |
| 4,417,624 | 11/1983 | Gockel | 166/77 X |
| 4,515,211 | 5/1985 | Reed et al. | 166/77 |
| 4,621,403 | 11/1986 | Babb et al. | 166/77 X |
| 4,899,823 | 2/1990 | Cobb et al. | 166/356 X |

*Primary Examiner*—Hoang C. Dang

*Attorney, Agent, or Firm*—M. H. Gay

[57] ABSTRACT

A system for handling a reeled tubing including a guide, a shear for cutting the tubing and a tubing injector including upper and lower strippers and guides and an enclosure for the injector. The enclosure in one form excludes sea water in an open bottomed enclosure and the other maintains pressure in a completely closed enclosure.

4 Claims, 10 Drawing Sheets

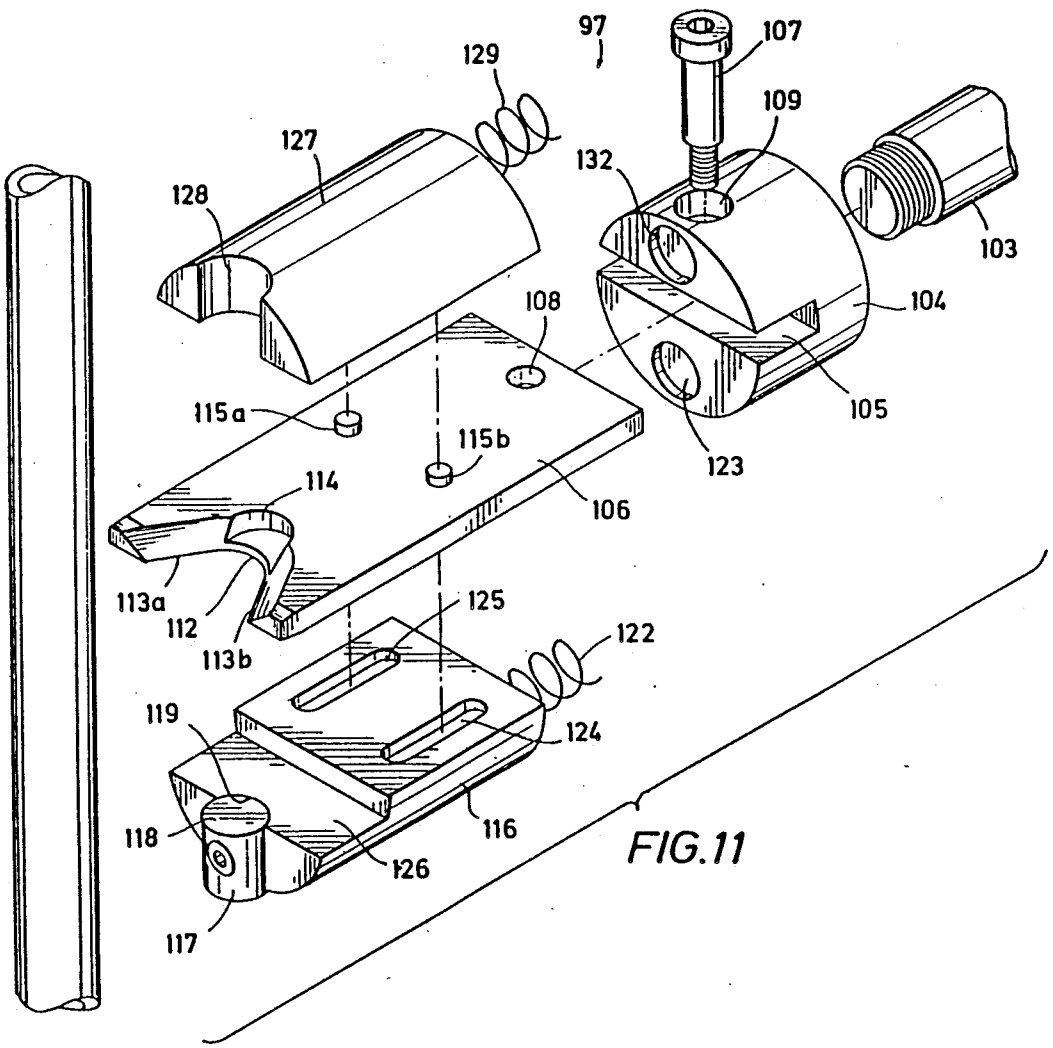
FIG. 11
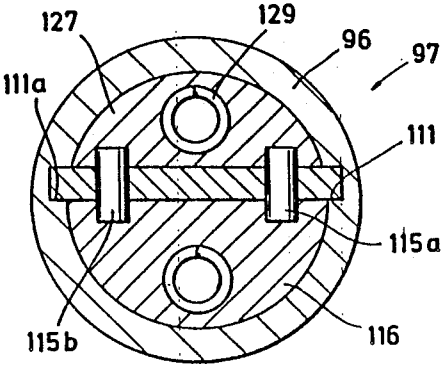
FIG. 10
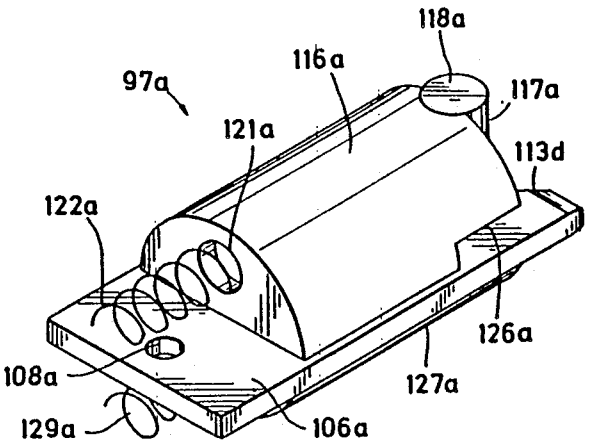

SYSTEM FOR HANDLING REELED TUBING

This is a division of my copending application Ser. No. 07/293,640, filed Jan. 5, 1989, now the U.S. Pat. No. 4,923,005.

This invention relates to systems for handling reeled tubing or pipe and more particularly to a system for moving tubing through a wellhead and for emergency release of the tubing from the wellhead.

Reeled tubing or pipe has conventionally been moved through a wellhead by an injector in land operations but the prior art does not teach a practical system for injector controlled tubing in subsea operations.

Shears are known for cutting a pipe free from a well in an emergency, but the cut pipe is open and fluid in the pipe above and below the cut may escape from the pipe.

The prior art does not teach a subsea injector, the control of pressure in a subsea injector enclosure, or the feeding of tubing and control of leakage of fluid which may occur about the tubing as it passes through the enclosure.

An object of this invention is to provide a system for handling reeled tubing which protects the tubing as it is fed into the system, permits shearing the tubing free from the wellhead while simultaneously crimping closed at least one cut end of the tubing and preferably both cut ends, controls the internal fluids in an injector enclosure, and prevents leakage of fluid pass the tubing to the exterior of the enclosure as the pipe is fed through the enclosure.

An object of this invention is to provide a guide for reeled tubing passing through a system for handling reeled tubing which prevents sharp bends of the tubing at the upper end of the system.

Another object is to provide a shear for reeled tubing which, as it shears, crimps at least one end of the cut tubing.

Another object is to provide a shear for reeled tubing which, as it shears, crimps both cut ends of the tubing.

Another object is to provide a shear for reeled tubing which as it shears forms the tubing into a shape which will receive the overshot of a fishing tool.

Another object is to provide a shear for reeled tubing which as it shears forms the tubing into a double C configuration which will accept the overshot of a fishing tool.

Another object is to provide a tubing injector with an enclosure and maintain the internal pressure slightly above the exterior pressure to prevent entry of sea water.

Another object is to provide a tubing injector with an open bottom enclosure and control the level of sea water in the enclosure with a float controlled source of gas under pressure.

Another object is to provide a tubing injector and enclosure therefor with one or more strippers for containing fluid against excess leakage about a tubing passing through the injector enclosure and recovering any fluid leaking pass the stripper.

Another object is to provide a reeled tubing system in which a shear is combined with an upper tubing guide and protector and an injector within an enclosure together with a tubing stripper is positioned below the shear in which a tubing is assisted in being centered in the shear by the guide, stripper and injector.

Another object is to provide a tubing stripper for an injector enclosure which collects and disposes of any fluid stripped from a tubing moving through the enclosure.

Other objects, features, and advantages of this invention will be apparent from the specification, drawings, and claims.

In the drawings, wherein a preferred embodiment of this invention is shown:

FIG. 10 is a sectional view along the line 10—10 of FIG. 9;

FIG. 11 is a diagrammatic view of a tubing and fragments of opposed rams with one ram exploded;

Figure 15:
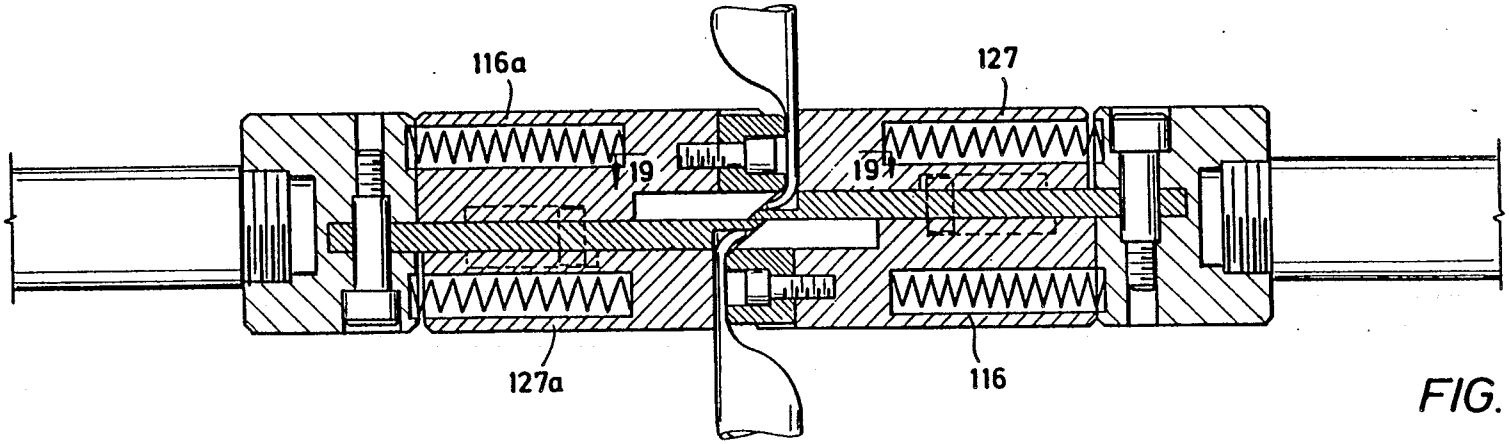
Figure 16:
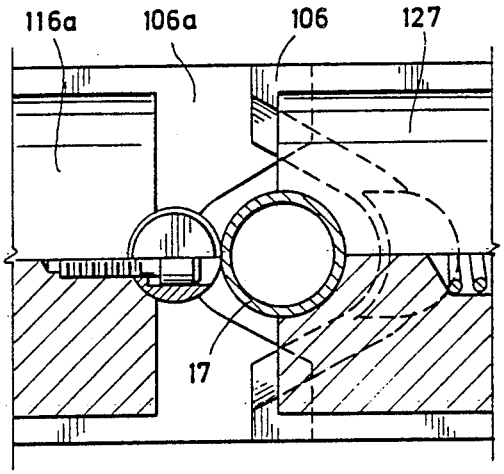
Figure 17:
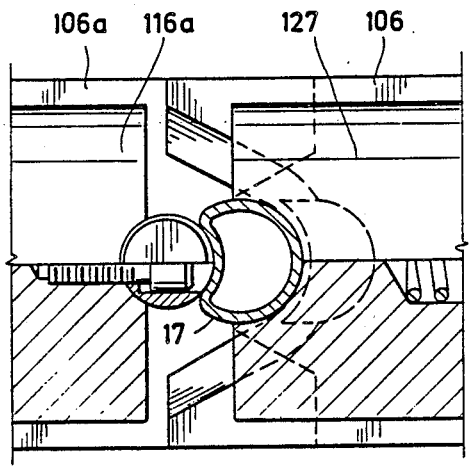
Figure 18:
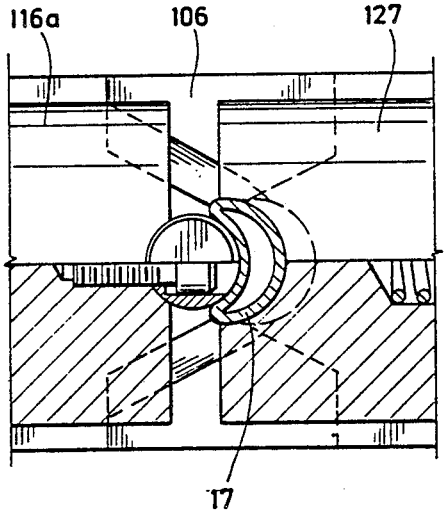

FIG. 12 through 15 are fragmental sections through the shear with the rams shown in sequential positions from initial engagement with a tubing to the final cut and crimped position; and FIG. 16 through 18 are top views of fragments of the rams partly in elevation and partly in section taken along the lines 16—16 through 19—19 of FIGS. 12 through 15 showing the sequential positions of the rams.

Figure 1:
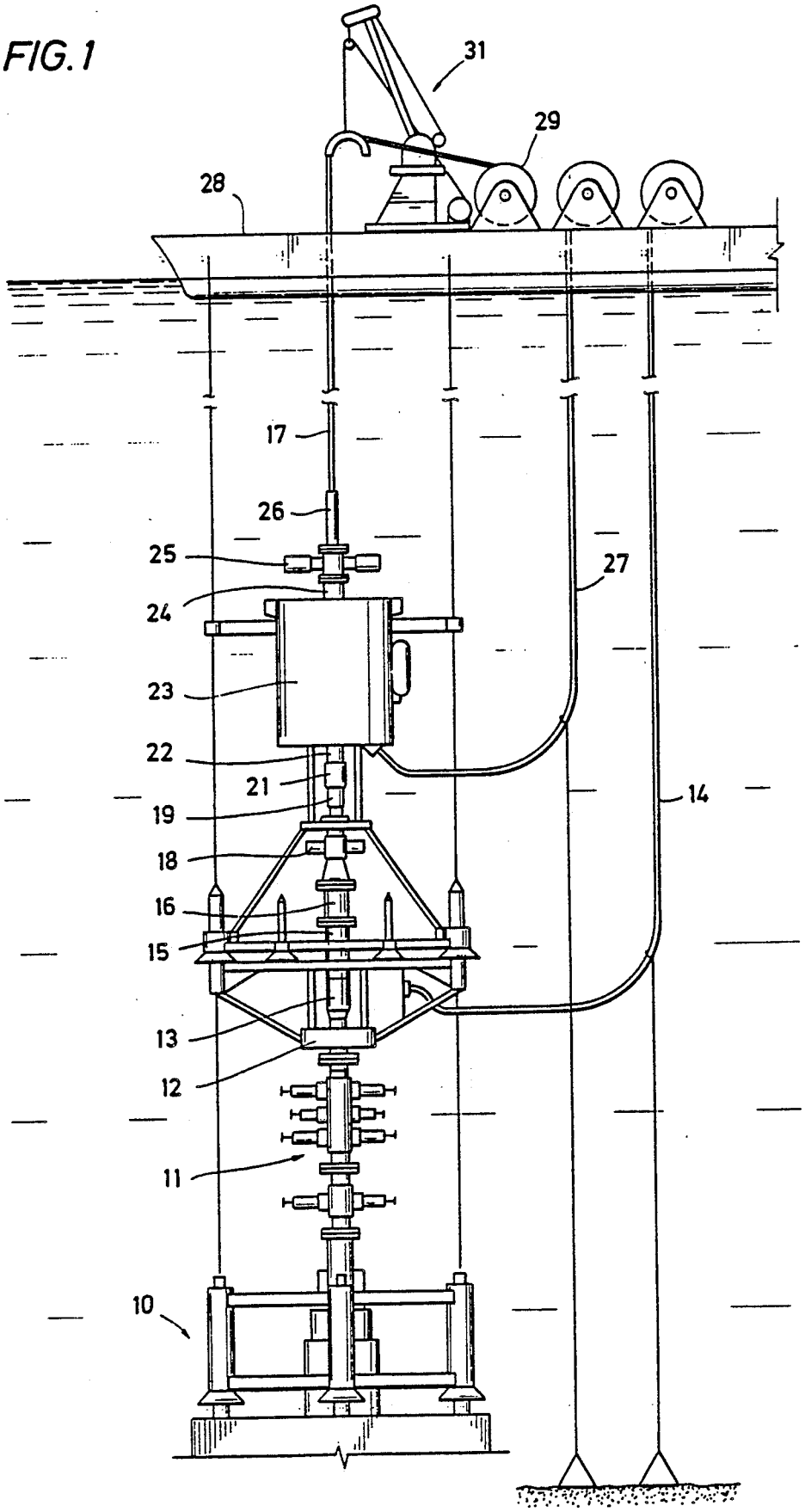
FIG. 1 is a schematic illustration of a wellhead with a blowout preventer stack in place and an injector, reeled tubing, shear and associated equipment landed on the wellhead and stack.

The system is shown generally in FIG. 1 and includes a wellhead 10 supporting a blowout preventer stack 11. Secured to the upper end of the stack 11 is a frame 12 which includes the lower female half 13 of a hydraulic latch. An umbilical 14 controls equipment both above and below the frame as desired.

Landed on the frame 12 is an assembly which includes an upper male half 15 of the hydraulic latch. Above the latch is a spool 16 which functions as a tool carrier during running and pulling of the reeled tubing 17. If desired a single blowout preventer 18 is provided above the spool to seal about the tubing when desired.

Above the blowout preventer 18 a stuffing box 19 seals about the tubing 17. Above the stuffing box 19 a ported collar 21 provides for collecting and disposing of any leakage from the stuffing box 19. Above the collar 21 is a ported stripper 22 for collecting and disposing of any fluid stripped from the tubing as it leaves the injector enclosure 23. The collar 21 and stripper 22 are omitted when the enclosure 23 has an open bottom and any leakage of fluid may rise into the enclosure. Above the injector enclosure is an upper ported stripper 24 for disposing of any leakage from the top of the enclosure about the tubing. Secured to the upper stripper is a shear 25 for emergency cutting of the tubing. The tubing is fed into the shear by a guide 26 which prevents sharp bends of the tubing at the shear. An umbilical 27 provides for control of equipment described above as desired. The tubing and previously described equipment is run from a vessel 28 which carries the tubing on a reel 29 and is provided with tubing handling equipment indicated at 31.

Figure 2:
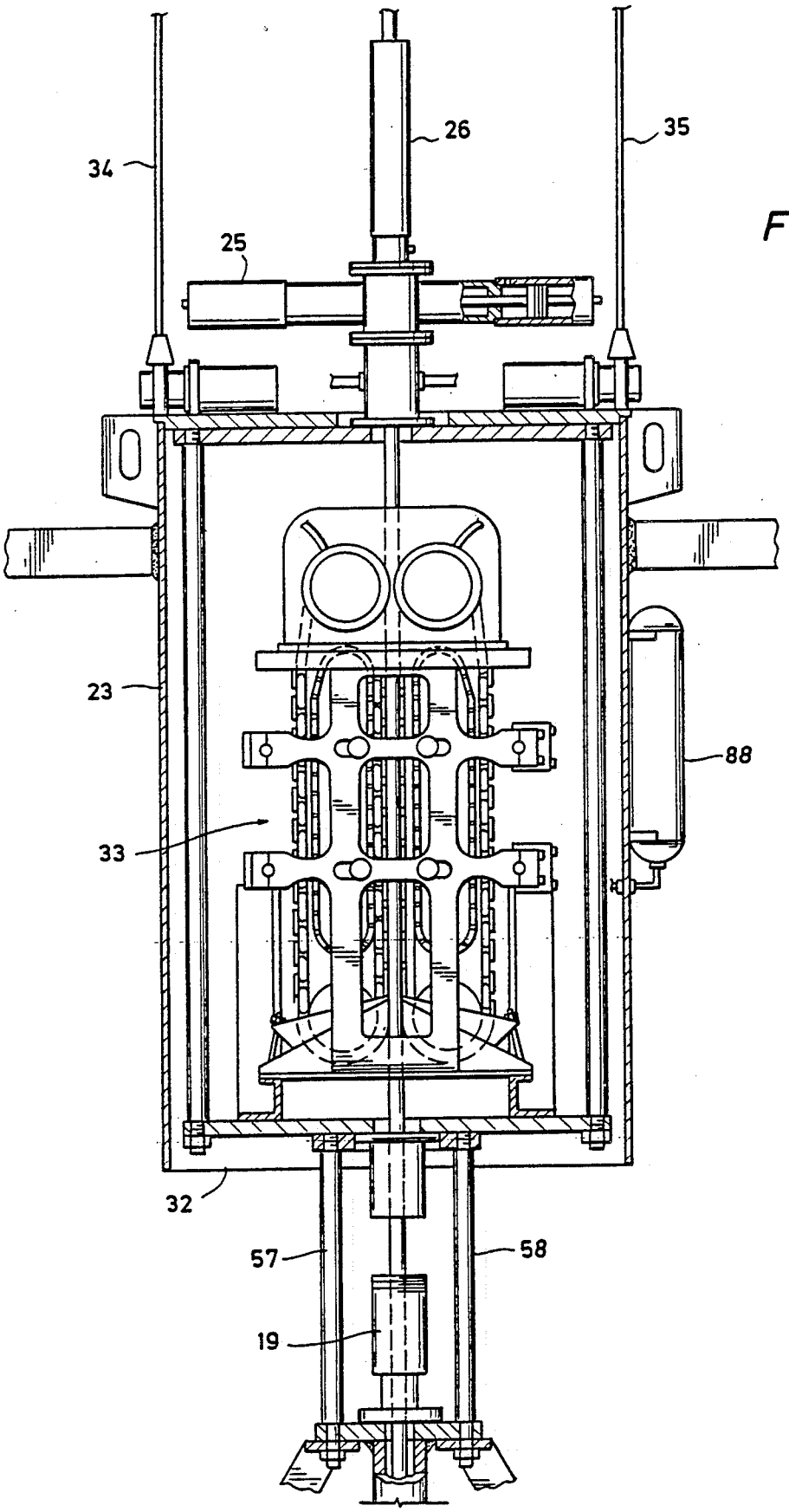
FIG. 2 is a view partly in elevation with parts broken away and partly in section of a shear, injector and enclosure, strippers and other associated equipment.

FIG. 2 illustrates the enclosure 23 with an open bottom 32. The lower stripper 22 and collar 21 are omitted in this design. Gas is maintained in the enclosure by a control system disclosed below. Within the enclosure 23 is an injector indicated generally at any desired design. For instance, one-half of the injector design of U.S. Pat. No. 4,655,291 may be used as illustrated in FIG. 2. Lines 34 and 35 are connected to a spreader bar for running and retrieving the assembly. They may be released and the bar, not shown, recovered during use of the assembly.

Figure 3:
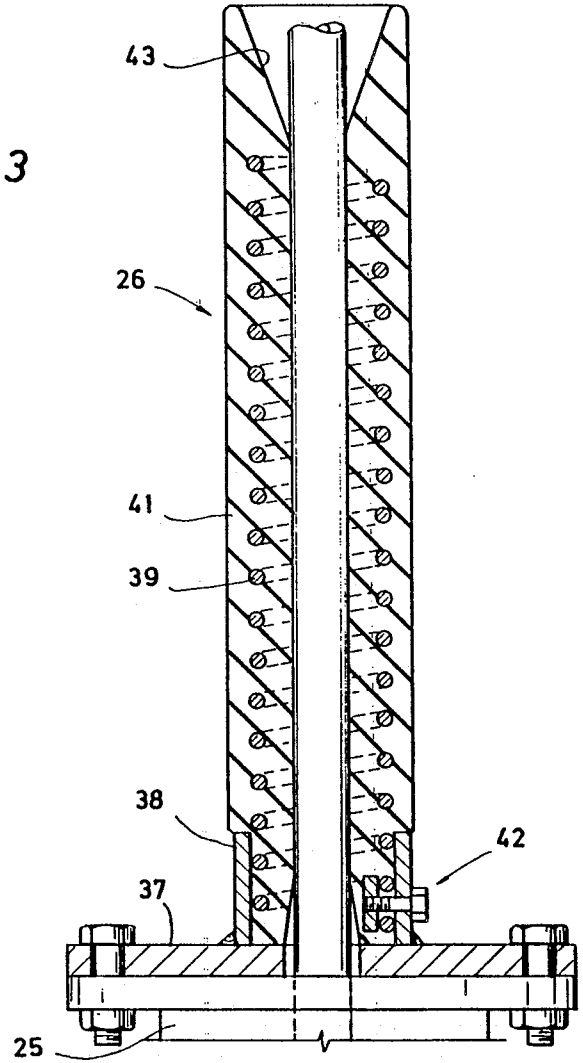
FIG. 3 is a view in section of a tubing guide.

FIG. 3 shows a tubing guide, indicated generally at 36, connected to the injector through the shear. The guide functions to protect the tubing against sharp bends at the top of the assembly and assists in centering the tubing in the shear. The guide includes a flange 37 for connection to the shear. The flange carries an upstanding tubular support 38. A coiled spring 39 is embedded in a tube of flexible material 41 such as polyurathene. One end of the spring and flexible material is secured in the tubular support 38 by a fastener indicated generally at 42. The upper end of the tube of flexible material has a cone shaped cutout 43 for introducing the tubing into the guide 36.

Figure 4:
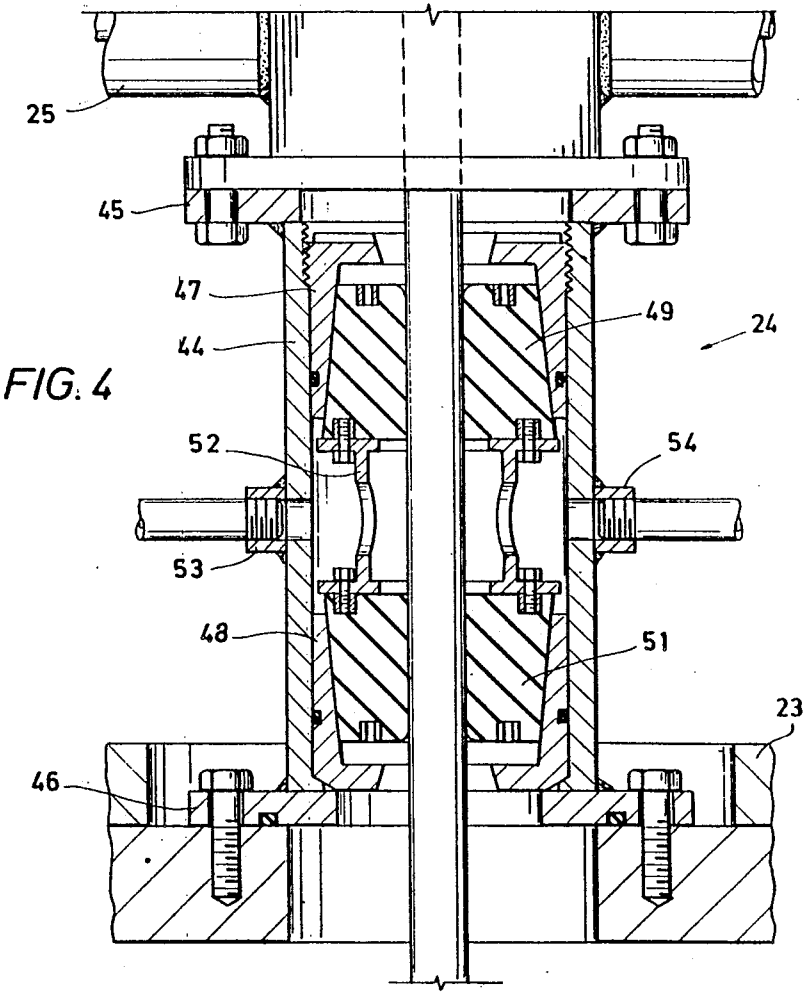
FIG. 4 is a view partly in section and partly in elevation of an upper stripper.

FIG. 4 illustrates the upper stripper 24 positioned between the enclosure 23 and shear 25. The stripper separates sea water from the fluid within the enclosure and collects and disposes of fluid from the enclosure which may leak from the enclosure. Any sea water passing the stripper is also collected and disposed of. The stripper serves the additional function of centering the tubing in the shear and in the injector.

The stripper includes a housing 44 with upper and lower connecting flanges 45 and 46 for connecting to the shear and injector enclosure. Within the housing upper and lower cup shaped receptacles 47 and 48 confront each other and are sealed with the housing. The lower receptacle bottoms against flange 46 and the upper receptacle, is threaded in the housing. A pair of resilient frustroconical seals 49 and 51, with their larger diameter ends confronting each other, sealingly engage the receptacles and wipe the tubing as it passes therethrough to strip liquid from the tubing. Holding 52 means between the seals maintain the seals in engagement with the receptacles and tubing. In this form of stripper the holding means is a rigid spacer. The spacer is secured to the seals in any desired manner as by studs so that removal of the top seal will automatically remove the bottom seal. Liquids stripped from the tubing will collect in the housing between the seals and be removed through the ports 53 and 54 for disposal.

Figure 7:
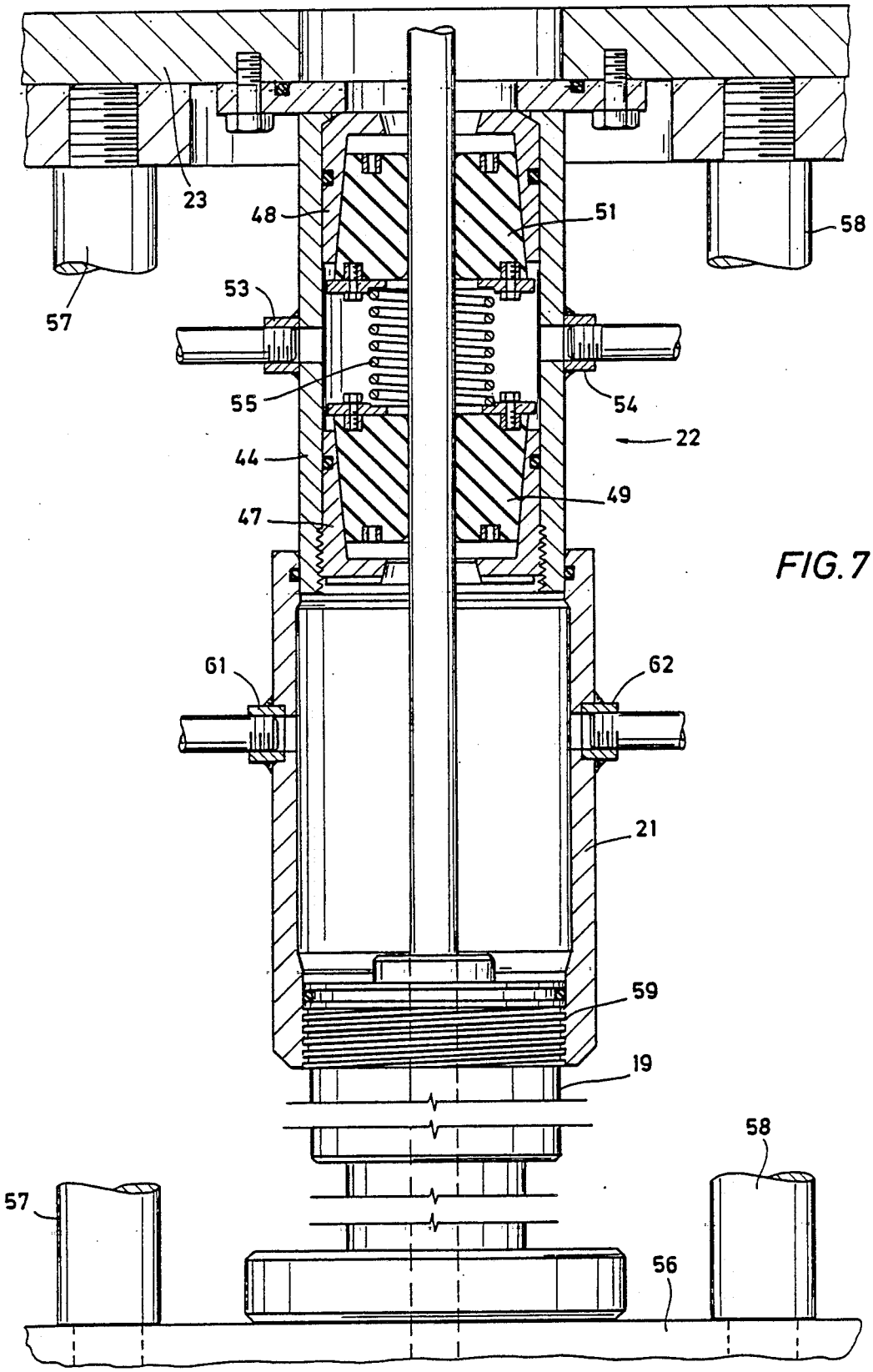
FIG. 7 is a view partly in elevation and partly in section illustrating a lower stripper, collection chamber and stuffing box.
Figure 8:
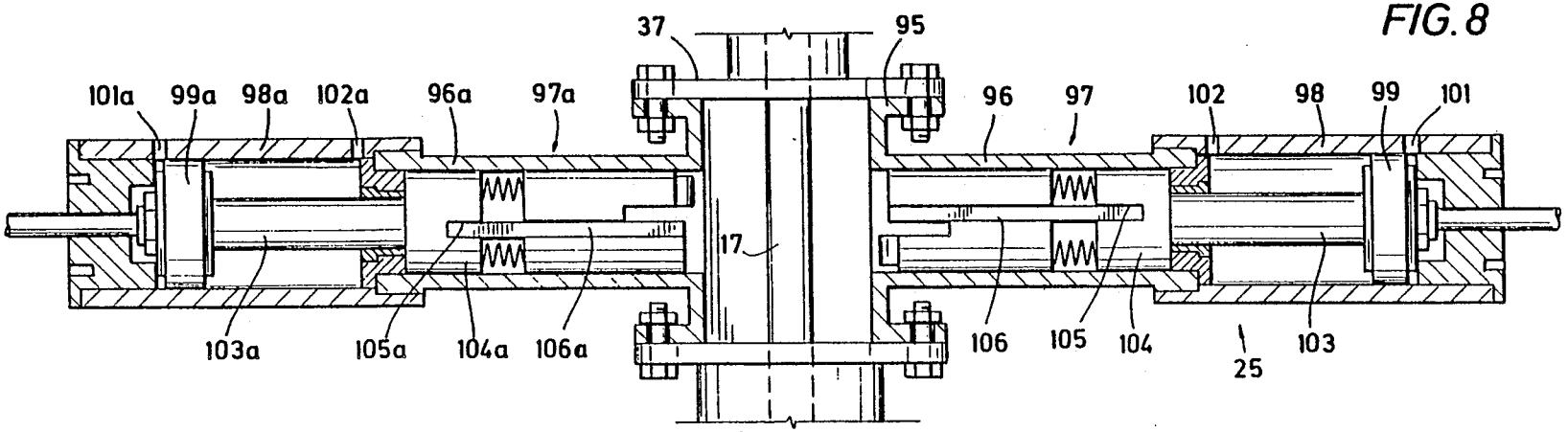
FIG. 8 is a view partly in elevation and partly in section illustrating a shear.

The lower stripper 22 is shown in FIG. 7. This stripper is identical in construction to the upper stripper except that it is inverted and the holding means is a spring 55. As with the upper stripper any fluid passing the two seals in collected in the housing and disposed of through the ports 53 and 54.

The stuffing box 19 is carried by a frame member 56. The frame member is spaced from the enclosure 23 by rods 57 and 58. With this construction the upper end of the stuffing box may be threaded and the sleeve 21 threadedly secured thereto by thread system 59. The upper end of the sleeve 21 has a sliding seal with the exterior of the lower stripper 22. Release of thread system 57 and raising of the sleeve 21 provides access to the stuffing box and to the seals of the lower stripper. Any fluids collecting in sleeve 21 may be disposed of through ports 61 and 62.

Figure 5:
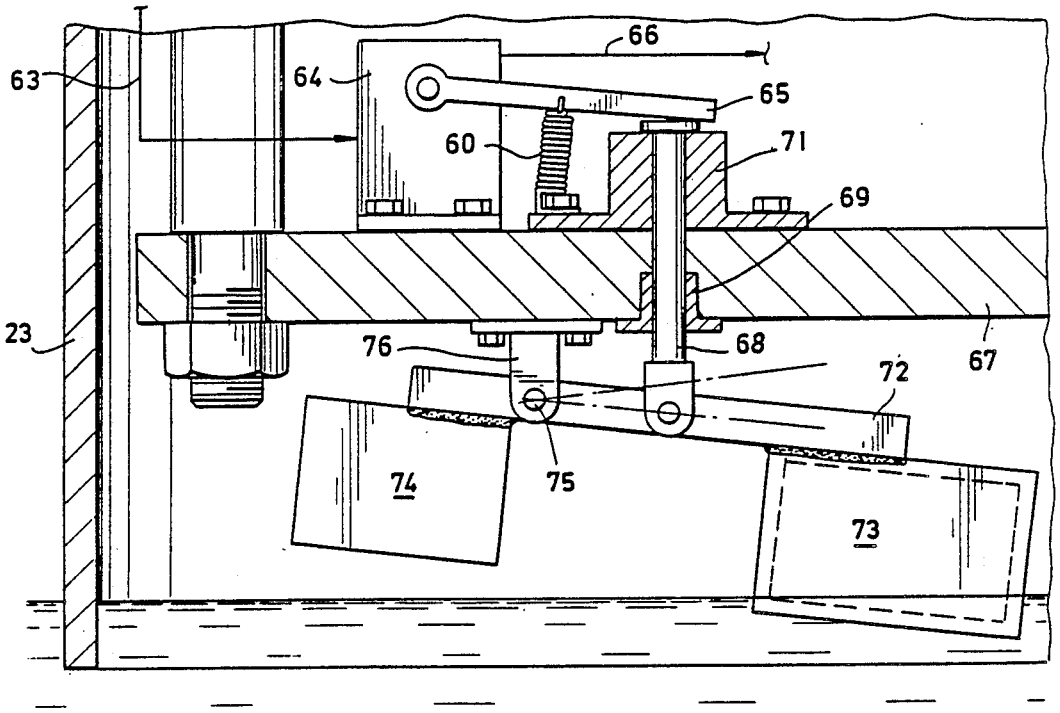
FIG. 5 is a fragmental section through a modified injector enclosure showing partly in elevation and partly in section a valve and float control for maintaining the level of sea water in an open bottom enclosure.

With the open bottom bell type enclosure shown in FIG. 2 means are provided to maintain the level of sea water in the enclosure below the injector. FIG. 5 illustrates this equipment. A source of compressed gas is provided by line 63. Gas from line 63 is fed int the enclosure through a two-way valve 64 of any desired construction. In the valve shown, raising of the arm 65 releases gas into the enclosure through line 66. With the arm in the position shown (full down position) the valve is closed by the tension spring 60. The arm is controlled by a float system. The valve 64 is mounted on a structural member 67 in the enclosure 23. Also carried on this member is a plunger 68 which extends through bushings 69 and 71 in the structural member and engages arm 65. The plunger is carried by a float arm 72 which in turn carries a float 73 and a counterbalance 74. In view of the pressures involved in subsea operations the float is preferably of thick wall construction and the counterbalance 74 is designed to counterbalance the weight of the float. The arm 72 is hinged at 75 to ear 76 on the structural member 67. As the sea water in the bottom of the enclosure rises the valve 64 opens to admit gas under pressure into the enclosure to drive sea water down to the desired level where it will not reach the injector, thus protecting the injector. As the sea water reaches the desired level the valve is closed.

In the form of invention shown in FIG. 1 the injector enclosure is substantially fluid tight. As the tubing moves through the strippers 22 and 24 leakage past the strippers may occur. Pressure in the enclosure is preferably maintained at a level above sea water pressure surrounding the enclosure to insure that sea water does not enter the enclosure. A preferred system for maintaining pressure is shown in FIG. 6.

The system for maintaining an elevated pressure in the enclosure includes a pressure multiplier driven by sea water to maintain the desired internal pressure and conduits in the umbilical to monitor and add or remove fluid from the enclosure 23. Due to the pressures involved the enclosure is preferably filled with liquid which may act as a lubricant for the injector.

One wall of the enclosure 23, such as the bottom wall 77 has a port 78 therein. A cylinder 79 has one end section 81 in sealing communication with said port and its other end section 82 communicating with the interior of the enclosure. The end section 81 is larger in diameter than the end section 82. A piston 83 is provided in section 81 an a second piston 84 is provided in section 82. The pistons are connected by a rod 85. The two pistons and rod may be fabricated as a single part as suggested by FIG. 5. To provide for control it i preferred that the relative diameters of the pistons generate more force than desired in the enclosure and a control pressure be exerted on the rod side of the larger piston 83 to maintain the desired pressure. For this purpose the rod side of cylinder section 81 is ported at 86 and a cross fitting 87 is in fluid communication with the port 86. One leg of the fitting 87 communicates with a gas charged bladder type accumulator 88 through line 89. Another leg communicates with a pressure gauge (not shown) through line 91. The remaining leg of the cross communicates with the surface through line 92 and the umbilical for adding and removing fluid from the annulus between the rod 85 and the cylinder section 81. The pressure could be monitored through line 92 but a separate line 91 is preferred. As a further control feature the gas side of the accumulator may have a line 93 communicating with the surface through the umbilical. Preferably a line 94 communicates the interior of the enclosure with the surface through the umbilical to add and remove fluid from the interior of the enclosure.

Figure 6:
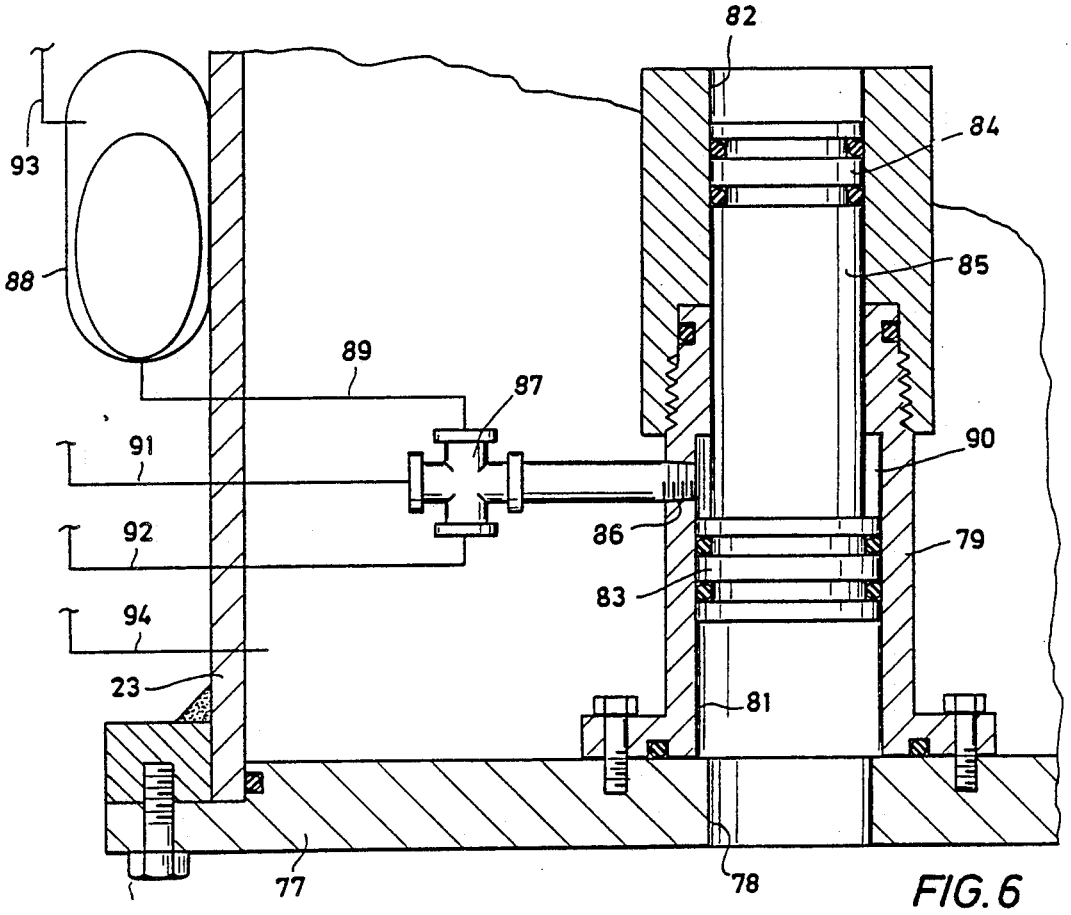
FIG. 6 is a view partly in elevation and partly in section of a fragment of the enclosure of FIG. 2 illustrating a pressure control system.

In the use of the system of FIG. 6 the accumulator permits changes in volume in chamber 90 while maintaining the pressure substantially constant. The pressure in the chamber is monitored and the desired pressure maintained in the chamber by transferring fluid through line 92 and holding this fluid under the desired pressure. Thus pressure in the enclosure 23 acting on piston 84 plus pressure in the chamber 90 acting on the rod end of piston 83 opposed sea water pressure on piston 83. By varying the pressure in chamber 90 the desired pressure differential across the wall of enclosure 23 may be maintained. Losses due to escape of fluid and compression of fluid within the enclosure may be made up through line 94. The gas charge in the accumulator 83 may be varied as desired by transferring gas through line 93.

FIGS. 8, 9, 10 and 11 best illustrate the shear 25. The design of the shear resembles a blowout preventer in providing for reciprocating rams to cut and crimp the tubing 17. The shear includes a spool like central section 95 through which the tubing 17 extends and to which equipment above and below the shear may be attached. Opposed cylindrical ram housings 96 and **96*a* extend from the central section 95 and contain the opposed rams indicated generally at 97 and 97*a*. Extending from the ram housings are the ram actuators housings 98 and 98*a* which provide cylinders for the pistons 99 and 99*a* for extending and retracting the rams. Hydraulic fluid acting on the pistons through ports 101, 101*a*, 102 and 102*a* extend and retract the pistons and the rams. The pistons carry connecting rods 103 and 103*a*** to which the rams are secured.

The rams include the carriers 104 and **104*a* secured to the connecting rod in any desired manner as by the threaded connection shown. The carriers are provided with transverse slots 105 and 105*a* for receiving the cutting blades 106 and 106*a*. The blades are secured to the carriers by studs 107 and 107*a* which pass through bores 108 and 108*a* in the blade and are secured in bores 109 and 109*a* in the carriers. The blades are maintained in a horizontal plane by sliding in slots 111 and 111*a* in housing 96 (FIG. 10**).

The blades 106 and **106*a* have horizontally extending cutting edges 112 and 112*a* which are preferably formed as arcs of a circle and more preferably as substantially semicircular in form. Extending from the cutting edges are substantially V shaped guide and cutting edges 113*a*, 113*b*, 113*c* and 113*d***.

On their nonadjacent sides the blades are cut out at 114 and **114*a***. The cutouts are adjacent the cutting edges. Preferably the cutting edges are beveled away from each other and the cutouts extend from the beveled surfaces. It is further preferred that the cutouts be substantially semi-circular in form to assist in maintaining the cut and crimped pipe in semi-circular form.

Blade 106 carries stop pins **115*a* and 115*b* extending above and below the blades. Similar pins are carried by blade 106*a*, one of which is shown in dashed lines in FIG. 14 at 115*c***.

Figure 9:
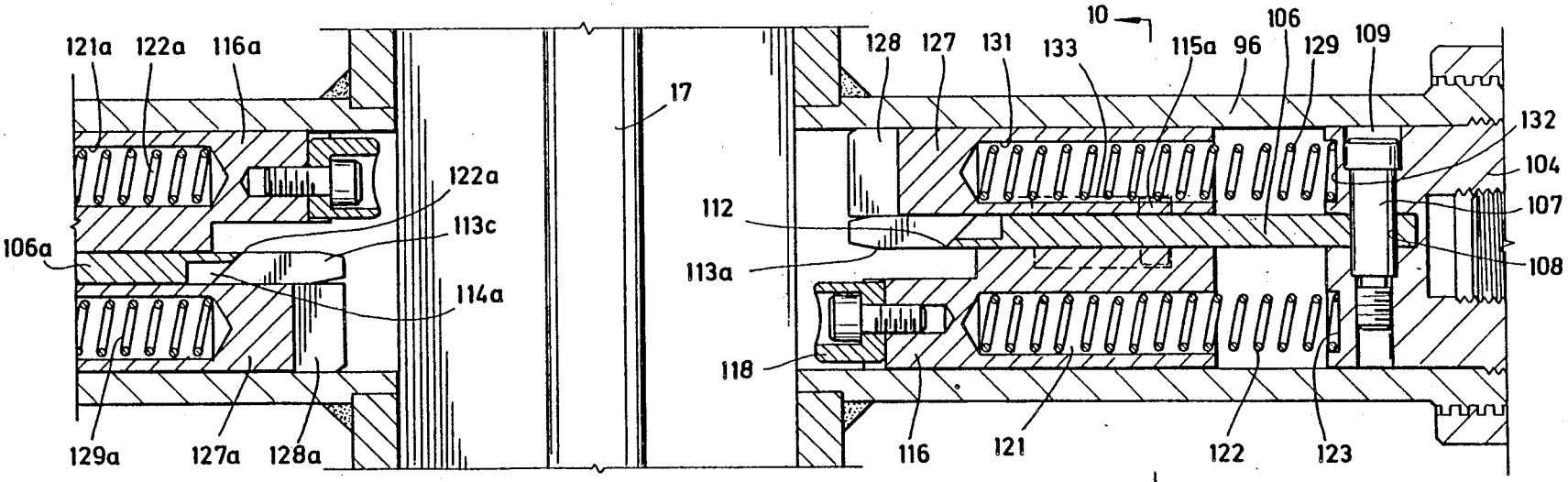
FIG. 9 is a partial sectional view of a shear with a tubing therein.
Figure 12:
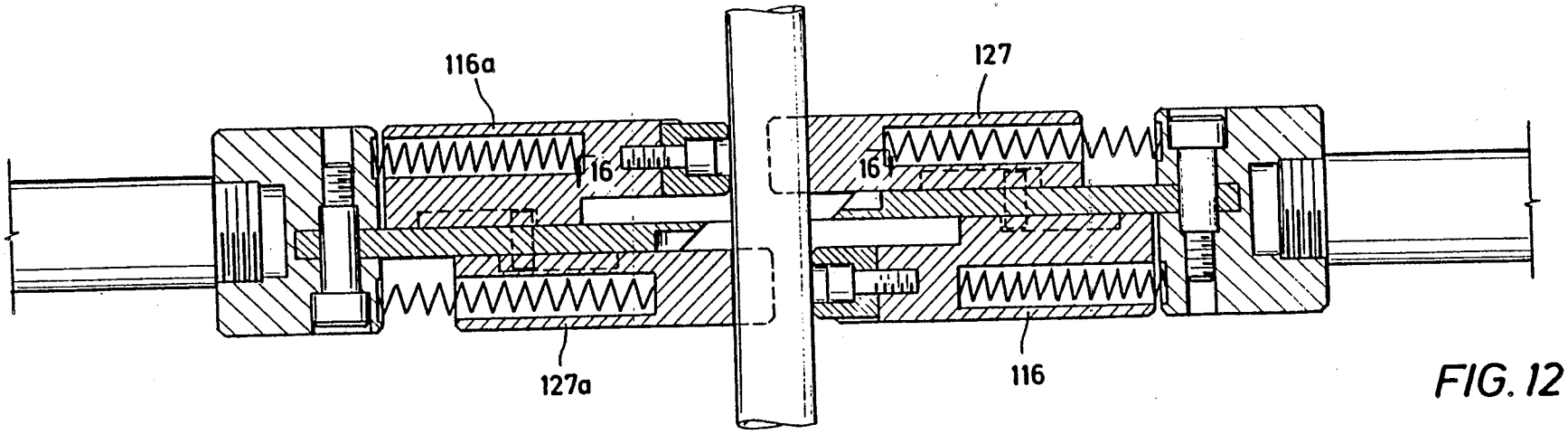
Figure 13:
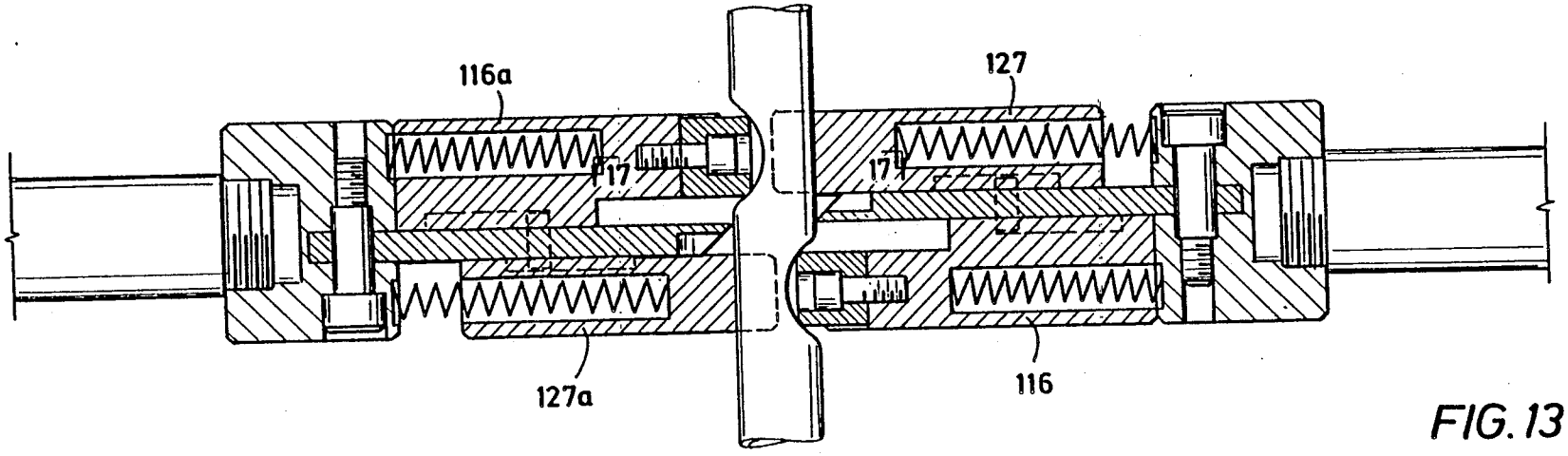
Figure 14:
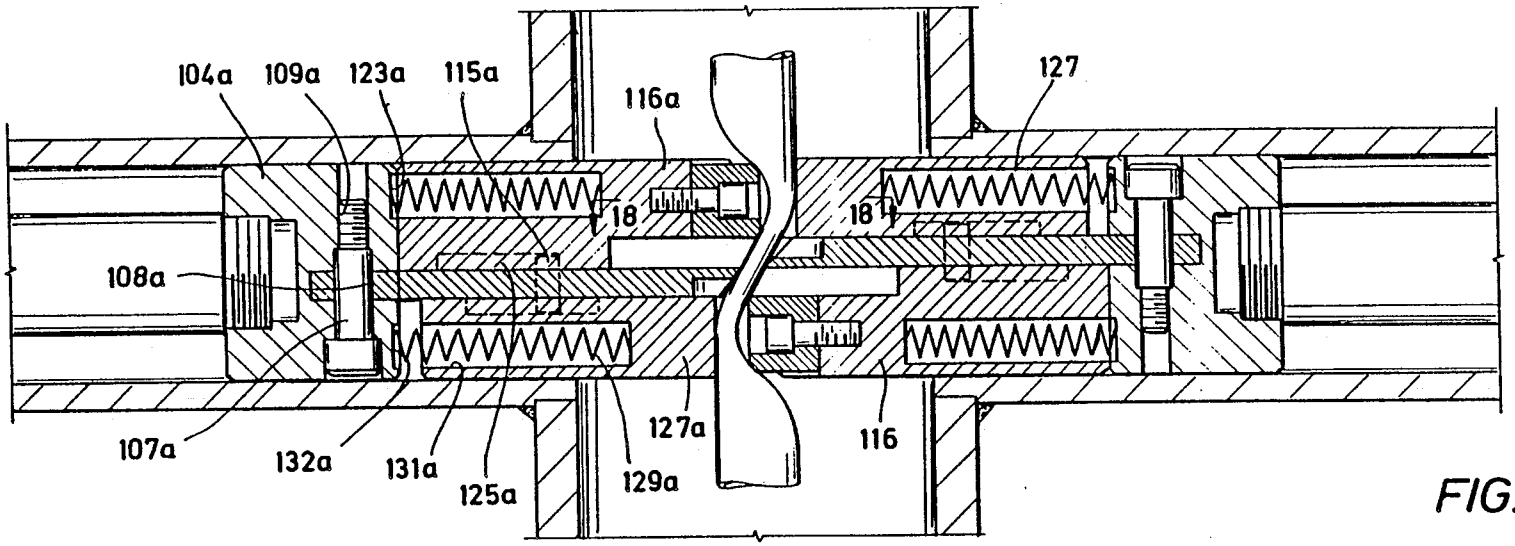
Figure 19:
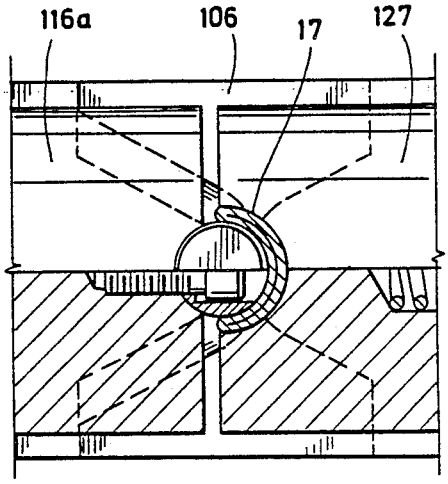

Abutment members are provided on the rams for forming the tube 17 in the double C shape shown in FIG. 19. A lower abutment member 116 is positioned below relatively upper blade 106. This abutment member has a substantially semi-circular vertically extending abutment surface 117 for bending the wall of a vertically extending tube into a double C configuration. Preferably the surface 117 is provided by a cylindrical member 118 secured in a concave notch 119 in the abutment face of ram 116. A blind bore 121 extends from the rear of member 116 and a spring 122 in this bore is received in a shallow blind bore 123 in carrier 104 (FIG. 9). This spring extends abutment member 116 to engage the end of slots 124 and 125 with stops **115*a* and 115*b* as shown in FIG. 9. The ram 116 can thus slide on blade 106 until it engages carrier 104 while the blade 106** is moving forward.

On the opposite side of the tubing the relatively lower blade **106*a* carries a relatively upper abutment member 116*a* having a substantially semi-circular vertically extending abutment surface 117*a* provided by cylindrical member 118*a*. A blind bore 121*a* extends from the rear of member 116*a* and a spring 122*a* in this bore is received in a shallow blind bore 123*a* in carrier 104*a*. This spring extends abutment member 116*a* to engage the end of slots in the abutment member, similar to slot 124 and 125, with stops, one of which is shown at 115*c* in FIG. 14. One of these slots is shown in dashed lines at 125*a* in FIG. 14**.

Abutment member 116 is notched at 126 to receive opposed blade **106*a*. Abutment member 116*a* is notched at 126*a* to receive opposed blade 106**.

To assist in centering and backing up the tubing as it is formed into a double C and cut and crimped, ram 97 is provided with a sliding abutment member 127 and ram **97*a* is provided with a sliding abutment member 127*a*. These abutment members are provided with semi-circular concave abutment surfaces 128 and 128*a* to receive and center the tubing during closing of the rams. Abutment member 127 is urged toward the tubing by a spring 129 compressed in blind bores 131 and 132 in the abutment member 127 and carrier 104. The abutment member carries slot such as 124 and 125, one of which is shown in dashed lines at 133 in FIG. 9**.

Abutment member **127*a* is urged toward the tubing by a spring 129*a* compressed in blind bores 131*a* and 132*a* in the abutment member 127*a* and carrier 104*a***.

Preferably the two rams are identical but relatively inverted. Also the several parts of the rams are duplicate parts to simplify manufacture and reduce costs.

Operation of the shear is illustrated sequentially in FIGS. 9 and 12 through 19. The tubing is generally centered in the shear by the guide 26 above, and the injector 33 and stripper 24 below as illustrated in FIG. 9. When the shear is activated the rams close to the position illustrated in FIGS. 12 and 16. The springs urging the centering abutment members 126 and **126*a* toward the tubing 17 are still expanded while the springs urging the forming abutment members 116 and 116*a* have been substantially collapsed. The blades 106 and 106*a* have overlapped as shown in FIG. 16. The rams now hold the tubing centered in the V shaped guide-cutting edges of the blades and the centering faces of abutment members 126 and 126*a***.

As the rams continue to close the forming abutment members bottom out on the carriers and the tubing is bent into reverse double C configurations at vertically spaced points, cut and both cut ends crimped as illustrated. As illustrated the tubing will be stretched in the area of the cut and will be crimped in the cutouts on the blades. The bent and crimped section of the tubing will remain within its original cylindrical configuration and receive an overshot for fishing out the lower section of the tubing if desired. FIG. 15 shows the preferred final relationship in which the centering abutment members 126 and 126*a* have bottomed out on the carriers to cooperate with the forming abutment members to completely collapse the pipe into the double C configuration. FIG. 15 shows that after cutting the tubing is bent into a crimped condition in the blade cutouts which are preferably semicircular to assist in maintaining the tubing in accurate form to receive an overshot.

A single blade and opposed forming and centering rams could be employed if desired. Other arrangements of the rams and blades could be employed, such as positioning the forming abutment surfaces on the same ram, but the illustrated arrangement is preferred.

In the use of the system the blowout preventer stack is first run on the wellhead. Then the injector with the tubing extending therethrough and the associated equipment is run and landed on the stack as illustrated in FIG. 1. The tubing is then utilized in the usual manner in the well. Any leakage through the stuffing box and from the strippers is collected and disposed of. The injector enclosure is maintained at the desired pressure and sea water is excluded therefrom.

In the event of an emergency the shear 25 may be operated to shear the tubing 17 and free the tubing carried by the vessel 28 from the wellhead. The tubing is preferably crimped at both cut ends to retain fluids therein. Even if some leakage occurs through the crimps this is more desirable than an open tubing draining into the sea and well pressure possibly forcing fluids into the sea through an open tubing. After conditions return to normal a conventional overshot may be run to engage the tubing in the shear and the fish raised to the surface.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A tubing handling system for underwater service comprising;

a tubing injector for moving tubing through a subsea wellhead, an open bottom enclosure for said injector, a source of gas under pressure, and means including a float operated valve metering said gas into said enclosure and maintaining the water level in said enclosure below said injector.

2. The system of claim 1 wherein said float is counterbalanced.

3. A tubing handling system for underwater service comprising:

a tubing injector for moving tubing through a wellhead;

a fluid tight enclosure for said injector;

a cylinder having one end section communicating with water exterior of said enclosure and its other end section communicating with the interior of said enclosure;

said one end section of said cylinder of a larger diameter than said other end section;

a piston in each said end section;

rod means interconnecting said pistons;

fluid means connected to said cylinder between said pistons and including:

a bladder type accumulator with a gas charge, conduit means for monitoring pressure and for adding and venting fluid from said cylinder; and a conduit communicating with the enclosure for adding and removing fluid.

4. The system of claim 3 wherein upper and lower strippers are provided on the injector enclosure and strip liquid from the tubing as it passes therethrough, and said strippers collect and dispose of said liquid.

* * * * *